US010697399B2

(12) United States Patent
Choi

(10) Patent No.: US 10,697,399 B2
(45) Date of Patent: Jun. 30, 2020

(54) CANISTER PURGE SYSTEM AND METHOD FOR DIAGNOSING PURGE VALVE THEREOF

(71) Applicants: Hyundai Motor Company, Seoul (KR); KIA Motors Corporation, Seoul (KR)

(72) Inventor: Choo Saeng Choi, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 1 day.

(21) Appl. No.: 16/171,642

(22) Filed: Oct. 26, 2018

(65) Prior Publication Data

US 2019/0186423 A1 Jun. 20, 2019

(30) Foreign Application Priority Data

Dec. 14, 2017 (KR) ..... 10-2017-0172294

(51) Int. Cl.
*F02M 1/00* (2006.01)
*F02M 25/08* (2006.01)
*F02D 41/00* (2006.01)

(52) U.S. Cl.
CPC ..... *F02M 25/0827* (2013.01); *F02M 25/089* (2013.01); *F02M 25/0818* (2013.01); *F02M 25/0836* (2013.01); *F02M 25/0854* (2013.01); *F02M 25/0872* (2013.01); *F02D 41/0032* (2013.01)

(58) Field of Classification Search
USPC ..... 123/516, 518–520
See application file for complete search history.

(56) References Cited

U.S. PATENT DOCUMENTS

| | | | | |
|---|---|---|---|---|
| 9,587,595 | B2 | 3/2017 | Woods et al. | |
| 2006/0090553 | A1 | 5/2006 | Nagasaki et al. | |
| 2007/0246024 | A1 | 10/2007 | Sato | |
| 2016/0258389 | A1* | 9/2016 | Makino | F02M 25/0836 |
| 2016/0258390 | A1* | 9/2016 | Makino | F02M 25/0836 |
| 2017/0226939 | A1* | 8/2017 | Akita | B01D 53/02 |
| 2018/0135565 | A1* | 5/2018 | Choi | F02D 41/0032 |
| 2018/0347511 | A1* | 12/2018 | Makino | F02M 25/08 |
| 2019/0211760 | A1* | 7/2019 | Choi | F02D 41/0032 |

FOREIGN PATENT DOCUMENTS

| | | | |
|---|---|---|---|
| JP | 2003314379 | A | 11/2003 |
| JP | 2006132324 | A | 5/2006 |
| JP | 2007205210 | A | 8/2007 |
| JP | 2007218122 | A | 8/2007 |

* cited by examiner

*Primary Examiner* — John Kwon
(74) *Attorney, Agent, or Firm* — Brinks Gilson & Lione

(57) ABSTRACT

A method for diagnosing a purge valve of a canister purge system includes (a) determining whether a purge valve, which is installed on a purge pipe connecting a canister with an intake system of an engine, is open and whether a purge pump is running, wherein the purge pump is configured to pump evaporative emission captured in the canister toward the intake system, and (b) determining whether the purge valve is in a close stuck state, based on upstream pressure and downstream pressure of the purge pump, when the purge valve is open while the purge pump is running.

16 Claims, 5 Drawing Sheets

CANISTER PURGE SYSTEM AND METHOD FOR DIAGNOSING PURGE VALVE THEREOF

CROSS-REFERENCE TO RELATED APPLICATION

This application claims priority to and the benefit of Korean Patent Application No. 10-2017-0172294, filed on Dec. 14, 2017, which is incorporated herein by reference in its entirety.

FIELD

The present disclosure relates to a canister purge system provided in a vehicle and a method for diagnosing a purge valve thereof.

BACKGROUND

The statements in this section merely provide background information related disclosure and may not constitute prior art.

A canister purge system mounted in a vehicle connects a fuel tank with a canister through a fuel tank vapor line, captures evaporative emission evaporated from the fuel tank through the canister, and opens a purge control solenoid valve (PCSV) (hereinafter, referred to as "a purge valve") mounted on a purge pipe connecting the canister with an intake system of an engine under the purge control condition of the engine that the negative pressure of the engine is sufficiently formed, thereby returning the evaporative emission to the intake system.

However, we have discovered that engines have been developed and used with negative pressure relatively insufficient to transfer the evaporative emission, which is captured in the canister, to an intake system of an engine only by using the negative pressure of the engine, similarly to an engine such as TGDI HEV. Accordingly, an active canister purge system is applied to a vehicle, which is equipped with the types of engines having insufficient negative pressure, with a purge pump which forcibly pumps the evaporative emission captured in the canister and transfers the evaporative emission to the intake system of the engine.

The above information disclosed in this background section is only for enhancement of understanding of the background of the present disclosure and therefore it may contain information that does not form the prior art that is already known to a person of ordinary skill in the art.

SUMMARY

The present disclosure relates to a canister purge system improved to effectively diagnose whether a close stuck occurs in a purge valve and a method for diagnosing a purge valve of the canister purge system.

According to an aspect of the present disclosure, a method for diagnosing a purge valve of a canister purge system includes (a) determining whether a purge valve, which is installed on a purge pipe connecting a canister with an intake system of an engine, is open and whether a purge pump is running, wherein the purge pump is used to pump evaporative emission captured in the canister toward the intake system, and (b) determining whether the purge valve is in a close stuck state, based on upstream pressure and downstream pressure of the purge pump, when the purge valve is open while the purge pump is running.

Preferably, the upstream pressure is measured by using a first pressure sensor installed to be positioned at a front end of the purge pump, and the downstream pressure is measured by using a second pressure sensor installed to be positioned at a rear end of the purge pump.

Preferably, step (b) includes (b1) determining whether the downstream pressure exceeds first reference pressure which is preset, (b2) determining whether the upstream pressure exceeds second reference pressure, which is preset, when the downstream pressure exceeds the first reference pressure, and (b3) determining that the purge valve is in a high-level close stuck state, when the upstream pressure exceeds the second reference pressure.

Preferably, the first reference pressure is the downstream pressure made when the purge pump is running under a normal condition, in a state that the purge valve in a normal state is open.

Preferably, the second reference pressure is the upstream pressure made when the purge pump is running under a normal condition, in a state that the purge valve in a normal state is open.

Preferably, the second reference pressure is set to be a lower value such that a revolution per minute (RPM) of the purge pump is increased.

Preferably, the step (b) further includes (b4) determining that the purge valve is in a middle-level close stuck state when it is determined that the upstream pressure is equal to or less than the second reference pressure.

Preferably, the high-level close stuck state is a state that close stuck occurs in the purge valve such that flow of the evaporative emission is blocked by the purge valve, and the middle-level close stuck state is a state that the close stuck partially occurs in the purge valve such that the evaporative emission is allowed to pass through the purge valve and a flow resistance of the evaporative emission is more increased as compared to a flow resistance when the purge valve is in a normal state.

The step (b) is performed by comparing the second reference pressure and an upstream pressure measured after a specified reference time elapses from a time point at which the purge valve is open. According to an aspect of the present disclosure, a canister purge system includes a purge valve installed on a fuel tank vapor line connecting a canister with an intake system of an engine to transfer evaporative emission captured in the canister to the intake system of the engine and allowing or blocking a flow of the evaporative emission through the fuel tank vapor line, a purge pump installed on the fuel tank vapor line to pump the evaporative emission from the canister to the intake system, and a controller determining whether the purge valve is in a close stuck state, based on upstream pressure and downstream pressure of the purge pump, when the purge valve is open while the purge pump is running.

Preferably, the canister purge system further includes a first pressure sensor installed on the fuel tank vapor line to be interposed between the purge pump and the canister and measuring the upstream pressure and a second pressure sensor installed on the fuel tank vapor line to be interposed between the purge pump and the purge valve and measuring the downstream pressure.

Preferably, the controller determines that the purge valve is in a high-level close stuck state when the downstream pressure exceeds first reference pressure, which is preset, and the upstream pressure exceeds second reference pressure which is preset.

Preferably, the first reference pressure is the downstream pressure made when the purge pump is running under a normal condition, in a state that the purge valve in a normal state is open.

Preferably, the second reference pressure is the upstream pressure made when the purge pump is running under a normal condition, in a state that the purge valve in a normal state is open.

Preferably, the second reference pressure is set to be a lower value such that a RPM of the purge pump is increased.

Preferably, the controller determines that the purge valve is in a middle-level close stuck state, when the downstream pressure exceeds the first reference pressure and the upstream pressure is equal to or less than the second reference pressure.

Preferably, the high-level close stuck state is a state that close stuck occurs in the purge valve such that a flow of the evaporative emission is blocked by the purge valve, and the middle-level close stuck state is a state that the close stuck partially occurs in the purge valve such that the evaporative emission is allowed to pass through the purge valve and a flow resistance of the evaporative emission is more increased as compared to a flow resistance when the purge valve is in a normal state.

Preferably, the controller compares, with the second reference pressure, an upstream pressure measured after a specified reference time elapses from a time point at which the purge valve is open.

As described above, the present disclosure relates to the canister purge system and the method for diagnosing a purge valve of the canister purge system, which may effectively diagnose whether the purge valve is the close stuck state, and the degree of the close stuck, by using a pressure value provided from the pressure sensors installed at both ends of the purge pump.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given byway of example, reference being made to the accompanying drawings, in which.

Figure 1:
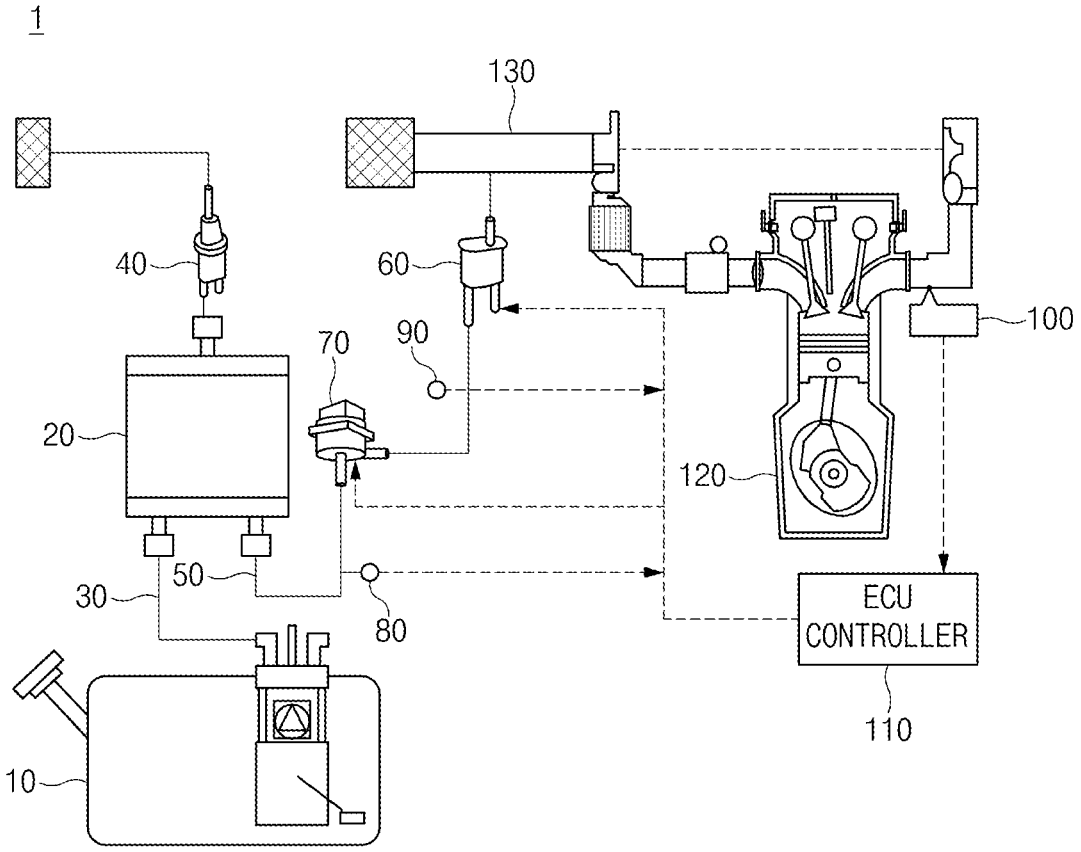
FIG. 1 is a schematic view illustrating a canister purge system.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the following description of elements according to the present disclosure, the terms 'first', 'second', 'A', 'B', '(a)', and '(b)' may be used. The terms are used only to distinguish relevant elements from other elements, and the nature, the order, or the sequence of the relevant elements is not limited to the terms. In addition, unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Figure 2:
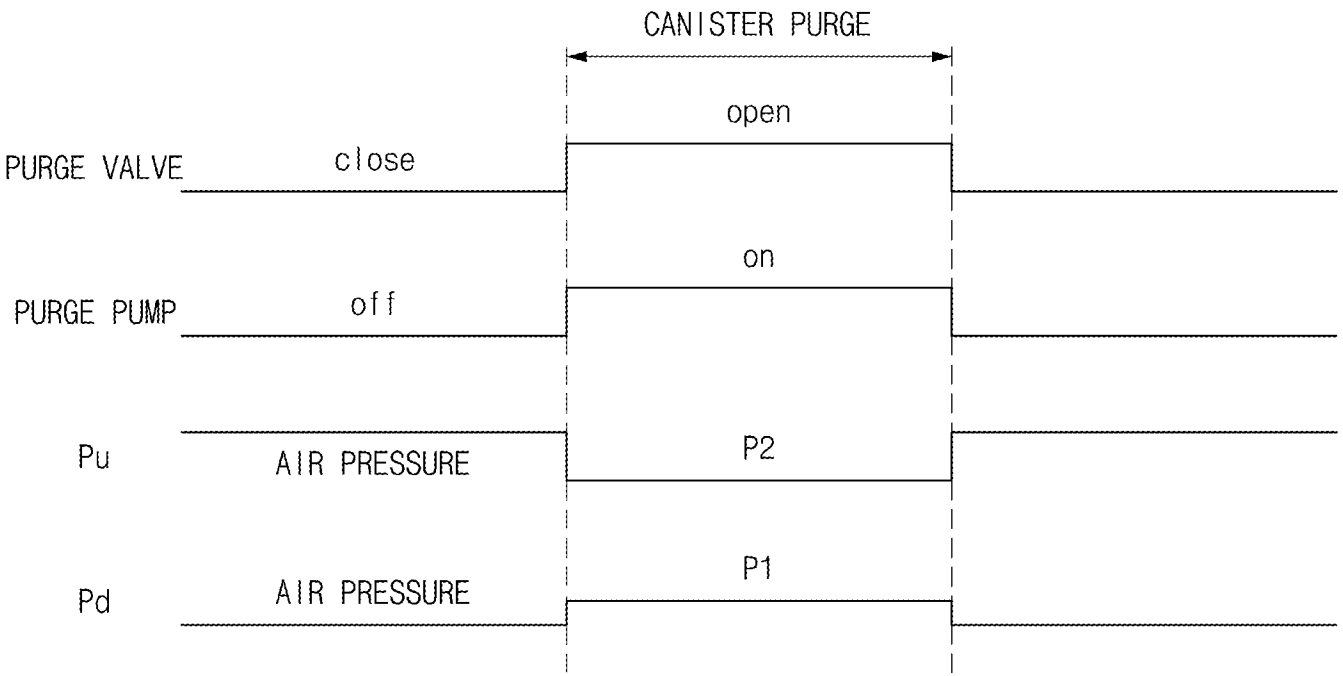
FIG. 2 is a graph illustrating the variation in the upstream pressure and the downstream pressure of a purge pump when the purge valve is in a normal state.

FIG. 1 is a schematic view illustrating a canister purge system, and FIG. 2 is a graph illustrating the variation in the front pressure and the rear pressure of a purge pump when the purge valve is in a normal state.

Hereinafter, a description will be made regarding the schematic configuration of an active canister purge system 1 to which a method for diagnosing a purge valve of the canister purge system is applicable, according to an exemplary form of the present disclosure.

Referring to FIG. 1, the active canister purge system 1 may include a fuel tank 10 storing fuel, a canister 20 capturing evaporative emission produced as the fuel stored in the fuel tank 10 is evaporated, a fuel tank vapor line 30 connecting the fuel tank 10 with the canister 20, a canister close valve 40 opening the canister 20 to introduce external air into the canister 20, a purge pipe 50 connecting the canister 20 with an intake system 130 of the engine 120, a purge valve 60 installed on the purge pipe 50 such that the movement of the evaporative emission is allowed or blocked, a purge pump 70 forcibly pumping the evaporative gas captured in the canister 20 to the intake system 130, a first pressure sensor 80 installed at one point of the purge pipe 50, which is interposed between the canister 20 and the purge pump 70, such that upstream pressure Pu of the purge pump 70 is measured, a second pressure sensor 90 installed at another point of the purge pipe 50, which is interposed between the purge pump 70 and the purge valve 60, such that downstream pressure Pd of the purge pump 70 is measured, an oxygen sensor 100 installed in an exhaust manifold of the engine 120 to measure an air-fuel ratio (A/F) by detecting an oxygen concentration included in the exhaust gas, and a controller 110 which controls the overall driving of the active canister purge system 1.

When a specific purge control condition is satisfied, the controller 110 may perform a purge control such that the purge valve 60 is open while being run and thus may transfer the evaporation emission captured in the canister 20 to the intake system 130. The purge control condition is not limited thereto, and the controller 110 may perform the purge control of the canister 20 when determining that the purge of the canister 20 is desired, by totally taking into consideration temperature information of a coolant and engine control information, which are received from various sensors.

In the purge control of the canister 20, the evaporative emission captured in the canister 20 is discharged from the canister 20 by the negative pressure forcibly applied by the purge pump 70 and then transferred to the intake system 130 through the purge valve 60. Accordingly, as illustrated in FIG. 2, in the purge control of the canister 20, the upstream pressure Pu of the purge pump 70 becomes lowered than the air pressure by the negative pressure provided from the purge pump 70 and then constantly maintained. The downstream pressure Pd of the purge pump 70 becomes slightly higher than the air pressure by the evaporative emission compressed in the purge pump 70 and then constantly maintained.

Figure 3:
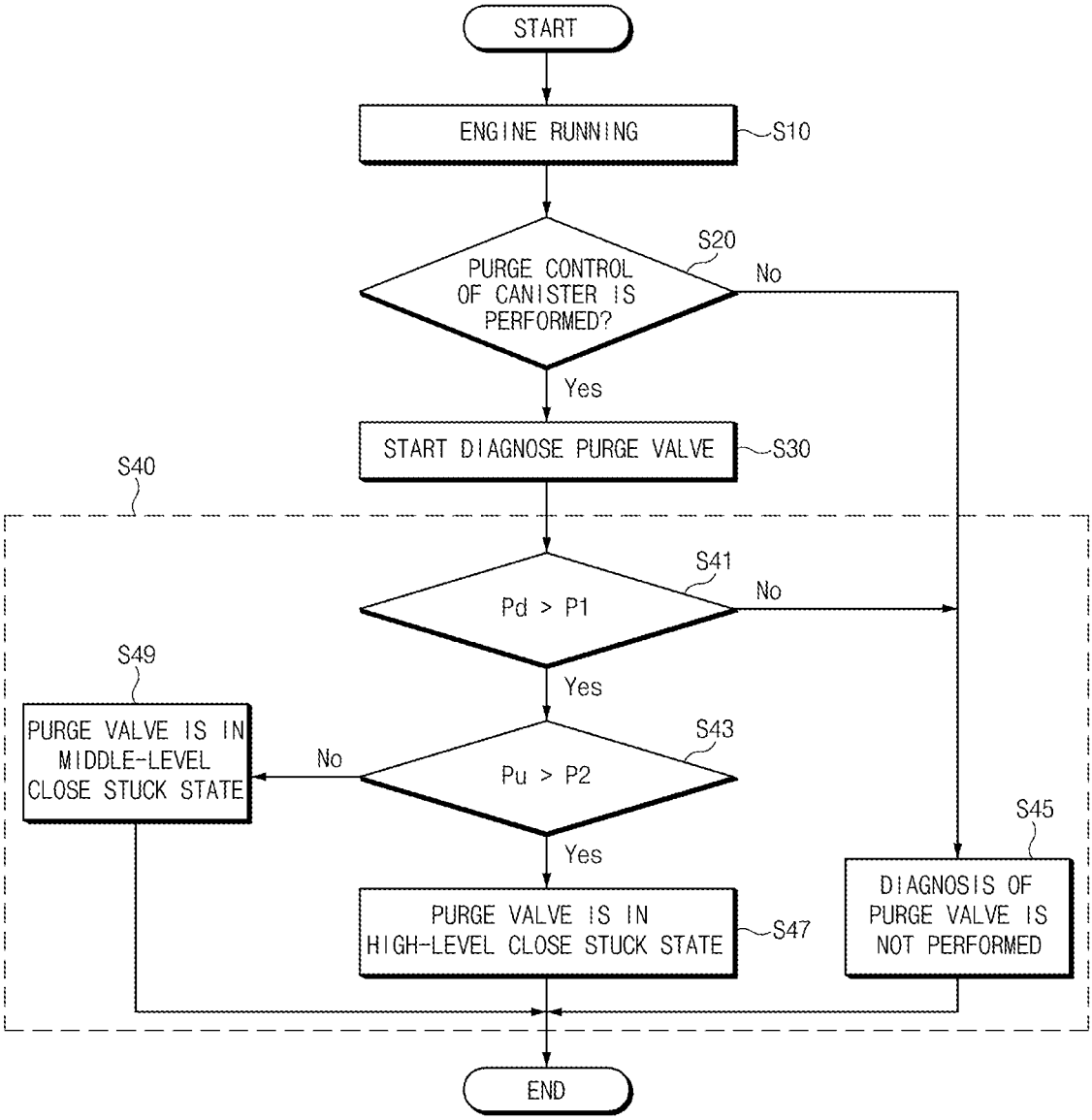
FIG. 3 is a flowchart illustrating a method for diagnosing the purge valve of the canister purge system, according to an exemplary form of the present disclosure.
Figure 4:
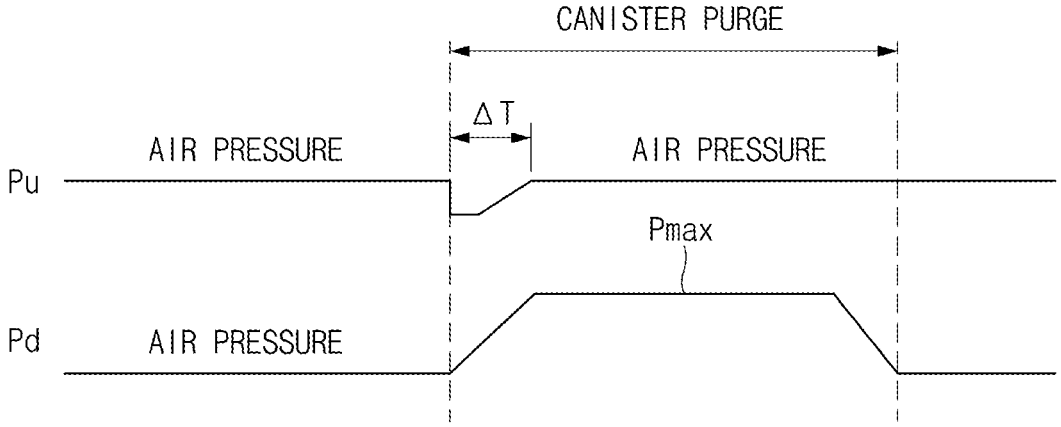
FIG. 4 is a graph illustrating the variation in the upstream pressure and the downstream pressure of a purge pump when the purge valve is in a high level close stuck state.
Figure 5:
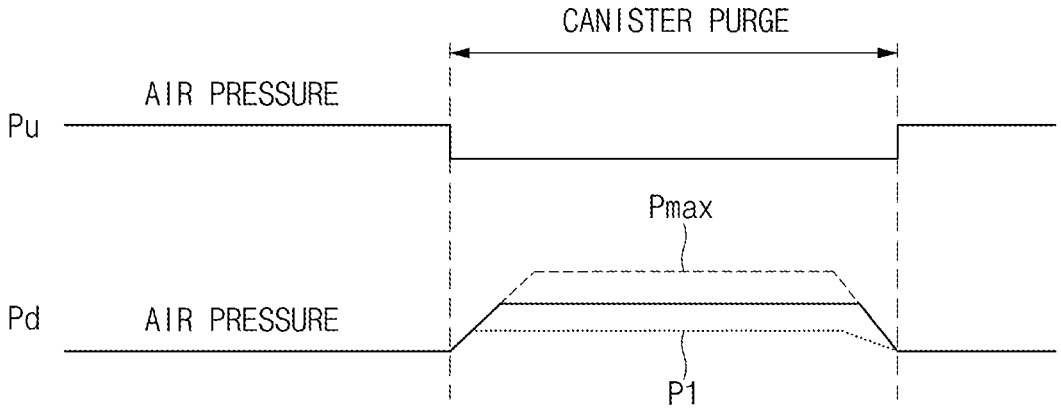
FIG. 5 is a graph illustrating the variation in the upstream pressure and the downstream pressure of a purge pump when the purge valve is in a middle level close stuck state.

FIG. 3 is a flowchart illustrating a method for diagnosing the purge valve of the canister purge system, according to an exemplary form of the present disclosure, FIG. 4 is a graph illustrating the variation in the upstream pressure and the downstream pressure of the purge pump when the purge valve is in a high-level close stuck state, and FIG. 5 is a graph illustrating the variation in the upstream pressure and the downstream pressure of the purge pump when the purge valve is in a middle-level close stuck state.

When the purge valve 60 is in the close stuck state, even if the purge valve 60 is open, the evaporative emission is stagnant without passing through the purge valve 60. According to an exemplary form of the present disclosure, the method for diagnosing the purge valve of the canister purge system is to diagnose whether the purge valve 60 is in the close stuck state.

First, the controller 110 may determine whether the purge control of the canister 20 is performed (S20) when the engine 120 is running (S10). To this end, the controller 110 may determine whether the purge valve 60 is open and whether the purge pump 70 is running. The controller 110 may determine that the purge control of the canister 20 is performed when the purge valve 60 is open while the purge pump 70 is running. In addition, the controller 110 may not perform the diagnosis of the purge valve 60 (S45) by determining that the purge control of the canister 20 is not performed when the purge valve 60 is in a close state, when the purge pump 70 is stopped, or when the purge valve is in the close state while the purge pump 70 is being stopped.

Then, the controller 110 starts diagnosing the purge valve 60 when the purge control of the canister 20 is performed (S30). For example, the controller 110 checks whether the purge pump 70 is running under a specific normal condition, receives the upstream pressure Pu of the purge pump 70 from a first pressure sensor 80, and receives the downstream pressure of the purge pump 70 from a second pressure sensor 90.

Thereafter, the controller 110 determines whether the purge valve 60 is in the close stuck state by using the upstream pressure Pu and the downstream pressure Pd of the purge pump 70 which are received from the first and second pressure sensors 80 and 90 (S40).

The controller 110 determines whether the downstream pressure Pd of the purge pump 70 is equal to or greater than specific first reference pressure P1 (S41).

Preferably, the first reference pressure P1 is the downstream pressure Pd of the purge pump 70 when the purge pump 70 is running under the normal condition, in the state that the purge valve 60, which is in a normal state that the close stuck does not occur, is open. As illustrated in FIG. 2, in this case, the first reference pressure P1 becomes slightly higher than the air pressure. For example, the first reference pressure P1 may be 2 kPa.

The close stuck of the purge pump 70 may be classified into a high level and a middle level depending on the close degree of the purge valve 60. The high-level close stuck refers to that the purge valve 60 is fully closed and thus the evaporative emission is stagnant in the purge pipe 50 without passing through the purge valve 60. The middle-level close stuck refers to that the purge valve 60 is partially closed and thus the flow resistance of the evaporative emission is increased from a normal value even if the evaporative emission passes through the purge valve 60.

As illustrated in FIG. 4, when the purge valve 60 is in the high-level close stuck state, the upstream pressure Pu of the purge pump 70 is decreased to be lower than the air pressure at the initial stage of the purge control of the canister 20, but is recovered to the air pressure after specific time (ΔT) elapses as the evaporative emission is stagnant without passing through the purge valve 60 and thus the negative pressure is not normally provided from the purge pump 70. In addition, in this case, after the downstream pressure Pd of the purge pump 70 is increased to be higher than the downstream pressure Pd of the purge pump 70, which is made when the purge valve 60 is in the normal state, that is, the first reference pressure P1, as the evaporative emission stagnant without passing through the purge valve 60 is compressed. Then, the downstream pressure Pd of the purge pump 70 is constantly maintained.

As illustrate in FIG. 5, when the purge valve 60 is in the middle-level close stuck state, the upstream pressure Pu of the purge pump 70 is constantly maintained after being decreased to be lower than the air pressure by the negative pressure provided from the purge pump 70. In this case, the downstream pressure Pd of the purge pump 70 may be constantly maintained after being increased to be higher than the downstream pressure Pd of the purge pump 70, which is made when the purge valve 60 is in the normal state, as the purge valve 60 is partially closed and thus the flow resistance of the evaporative emission is increased, and to be lower than the downstream pressure Pd of the purge pump 70 which is made when the purge valve 60 is in the high-level close stuck.

The controller 110 does not perform the diagnosis of the purge valve 60 based on the determination that the purge valve 60 is in the normal state, when the downstream pressure Pd of the purge valve 60 is equal to or less than the first reference pressure P1 (S45).

The controller 110 determines whether the purge valve 60 is in the high-level close stuck state or the middle-level close stuck state, based on the determination that the purge valve 60 is in the close stuck state, when the down pressure Pd of the purge pump 70 exceeds the first reference pressure P1. To this end, the controller 110 determines whether the upstream pressure Pu of the purge pump 70 exceeds a specific second reference pressure P2 (S43).

Preferably, the second reference pressure P2 is the upstream pressure Pu of the purge pump 70 when the purge pump 70 is running under the normal condition, in the state that the purge valve 60, which is a normal state that the close stuck does not occur, is open. As illustrated in FIG. 2, in this case, the second reference pressure P2 is lower than the air pressure. It is preferred that the second reference pressure P2 is lowered as the revolution per minute (RPM) of the purge pump 70 is increased. This is based on that the negative pressure provided from the purge pump 70 is increased as the RPM of the purge pump 70 is increased. For example, the second reference pressure P2 may be −5 kPa when the RPM of the purge pump 70 is 50,000 RPM, and may be −7 kPa when the RPM of the purge pump 70 may be 70,000 RPM.

The controller 110 may determine that the purge valve 60 is in the high-level close stuck state (S47) when the upstream pressure Pu of the purge pump 70 exceeds the second reference pressure P2. This is determined based on that the upstream pressure Pu of the purge pump 70 is maintained to the air pressure as the negative pressure is not normally provided from the purge pump 70 when the purge valve 60 is in the high-level close stuck state. However, even though the purge valve 60 is in the high-level close stuck state, the upstream pressure Pu of the purge pump 70 is lower than the air pressure during a specific time (ΔT) at the initial stage of the purge control of the canister 20. Accordingly, it is preferred that the controller 110 preferably compares the upstream pressure Pu of the purge pump 70 and the second reference pressure P2 after specific reference time elapses from a time point of starting the purge control. In this case, it is preferred that a reference time is set to be longer than the specific time (ΔT) spent until the upstream pressure Pu of the purge pump 70 is decreased to be lower than the air pressure and recovered to the air pressure at the initial stage of the purge control of the canister 20.

The controller 110 may determine that the purge valve 60 is in the middle-level close stuck state (S49) when the upstream pressure Pu of the purge pump 70 is equal to or less than the second reference pressure P2. This is determined based on that the upstream pressure Pu of the purge pump 70 is decreased to pressure approximate to pressure, which is made when the purge valve 60 is in the normal state, as the negative pressure is provided from the purge pump 70, when the purge valve 60 is in the middle-level close stuck state.

According to an exemplary form of the present disclosure, in the method for diagnosing the purge valve of the canister purge system, the diagnosing may be effectively performed regarding whether the purge valve 60 is in the close stuck state and the occurrence degree of the close stuck by using the pressure values provided from the pressure sensors 80 and 90 mounted at both ends of the purge pump 70.

Hereinabove, although the present disclosure has been described with reference to exemplary forms and the accompanying drawings, the present disclosure is not limited thereto, but may be variously modified and altered by those skilled in the art to which the present disclosure pertains without departing from the spirit and scope of the present disclosure claimed in the following claims.

Therefore, forms of the present disclosure are not intended to limit the technical spirit of the present disclosure, but provided only for the illustrative purpose. The scope of protection of the present disclosure should be construed by the attached claims, and all equivalents thereof should be construed as being included within the scope of the present disclosure.

What is claimed is:

1. A method for diagnosing a purge valve of a canister purge system including a controller, the method comprising:

(a) determining, by the controller, whether a purge valve, which is installed on a purge pipe connecting a canister with an intake system of an engine, is open while a purge pump is running, wherein the purge pump is used to pump evaporative emission captured in the canister toward the intake system and installed on the purge pipe arranged between the canister and the purge valve, where the controller is electrically connected to the purge valve and the purge pump; and (b) when the purge valve is open while the purge pump is running, determining, by the controller, whether the purge valve is in a close stuck state, based on an upstream pressure and a downstream pressure of the purge pipe, wherein the upstream pressure is measured on a portion of the purge pipe between the purge pump and the canister, and the downstream pressure is measured on a portion of the purge pipe between the purge pump and the purge valve.

2. The method of claim 1, wherein the upstream pressure is measured by using a first pressure sensor installed to be positioned at a front end of the purge pump, and wherein the downstream pressure is measured by using a second pressure sensor installed to be positioned at a rear end of the purge pump.

3. The method of claim 1, wherein the determining of whether the purge valve is in the close stuck state includes:

(b1) determining whether the downstream pressure exceeds a first reference pressure which is preset;

(b2) determining whether the upstream pressure exceeds a second reference pressure, which is preset, when the downstream pressure exceeds the first reference pressure; and (b3) determining that the purge valve is in a high-level close stuck state, when the upstream pressure exceeds the second reference pressure.

4. The method of claim 3, wherein the second reference pressure is the upstream pressure made when the purge pump is running under a normal condition, in a state that the purge valve in a normal state is open.

5. The method of claim 4, wherein the determining of whether the purge valve is in the close stuck state further includes:

(b4) determining that the purge valve is in a middle-level close stuck state when it is determined that the upstream pressure is equal to or less than the second reference pressure.

6. The method of claim 5, wherein the high-level close stuck state is a state that close stuck occurs in the purge valve such that flow of the evaporative emission is blocked by the purge valve; and wherein the middle-level close stuck state is a state that the close stuck partially occurs in the purge valve such that the evaporative emission is allowed to pass through the purge valve and a flow resistance of the evaporative emission is more increased as compared to a flow resistance when the purge valve is in a normal state.

7. The method of claim 3, wherein the determining of whether the upstream pressure exceeds the second reference pressure is performed by comparing the second reference pressure and an upstream pressure measured after a specified reference time elapses from a time point at which the purge valve is open.

8. A canister purge system comprising:

a purge valve installed on a fuel tank vapor line connecting a canister with an intake system of an engine to transfer evaporative emission captured in the canister to the intake system of the engine and allowing or blocking a flow of the evaporative emission through the fuel tank vapor line;

a purge pump installed on the fuel tank vapor line to pump the evaporative emission from the canister to the intake system; and a controller configured to determine whether the purge valve is in a close stuck state, based on upstream pressure and downstream pressure of the purge pump, when the purge valve is open while the purge pump is running.

9. The canister purge system of claim 8, further comprising:

a first pressure sensor installed on the fuel tank vapor line to be interposed between the purge pump and the canister and configured to measure the upstream pressure; and a second pressure sensor installed on the fuel tank vapor line to be interposed between the purge pump and the purge valve and configured to measure the downstream pressure.

10. The canister purge system of claim 8, wherein the controller determines that the purge valve is in a high-level close stuck state when the downstream pressure exceeds first reference pressure, which is preset, and the upstream pressure exceeds second reference pressure which is preset.

11. The canister purge system of claim 10, wherein the first reference pressure is the downstream pressure made when the purge pump is running under a normal condition, in a state that the purge valve in a normal state is open.

12. The canister purge system of claim 10, wherein the second reference pressure is the upstream pressure made when the purge pump is running under a normal condition, in a state that the purge valve in a normal state is open.

13. The canister purge system of claim 12, wherein the second reference pressure is set to be a lower value such that a revolution per minute (RPM) of the purge pump is increased.

14. The canister purge system of claim 10, wherein the controller determines that the purge valve is in a middle-level close stuck state, when the downstream pressure exceeds the first reference pressure and the upstream pressure is equal to or less than the second reference pressure.

15. The canister purge system of claim 14, wherein the high-level close stuck state is a state that close stuck occurs in the purge valve such that a flow of the evaporative emission is blocked by the purge valve; and wherein the middle-level close stuck state is a state that the close stuck partially occurs in the purge valve such that the evaporative emission is allowed to pass through the purge valve and a flow resistance of the evaporative emission is more increased as compared to a flow resistance when the purge valve is in a normal state.

16. The canister purge system of claim 10, wherein the controller compares, with the second reference pressure, an upstream pressure measured after a specified reference time elapses from a time point at which the purge valve is open.

* * * * *